US005642940A

United States Patent [19]

Scatizzi et al.

[11] Patent Number: 5,642,940

[45] Date of Patent: Jul. 1, 1997

[54] APPARATUS FOR THE PREPARATION OF MIXTURES, ESPECIALLY DYE SOLUTIONS

[75] Inventors: Mario Scatizzi, Pistoia; Mauro Anguillese, Carmignano; Moreno Bartalucci, Montemurlo, all of Italy

[73] Assignee: Tecnorama S.r.L, Prato, Italy

[21] Appl. No.: 602,250

[22] Filed: Feb. 15, 1996

[30] Foreign Application Priority Data

Mar. 21, 1995 [IT] Italy ..... PT95A0002

[51] Int. Cl.[6] ..... B01F 15/02

[52] U.S. Cl. ..... 366/150.1; 366/169.1; 366/286

[58] Field of Search ..... 366/150.1, 152.1, 366/152.2, 152.3, 152.4, 160.1, 160.2, 160.3, 162.1, 167.1, 168.1, 169.1, 170.2, 173.1, 177.1, 181.8, 285, 286, 242, 244, 245, 249, 251, 253, 154, 261, 279, 219

[56] References Cited

U.S. PATENT DOCUMENTS

| | | | |
|---|---|---|---|
| 4,095,287 | 6/1978 | Felser et al. | 366/194 |
| 4,514,094 | 4/1985 | Buckholz | 366/177.1 |
| 4,547,076 | 10/1985 | Maurer | 366/244 |
| 4,798,471 | 1/1989 | Laempe | 366/244 |
| 4,836,685 | 6/1989 | Verreault | 366/152.2 |
| 5,348,390 | 9/1994 | Schertenleib | 366/177.1 |
| 5,447,372 | 9/1995 | Araki et al. | 366/286 |

*Primary Examiner*—Robert W. Jenkins
*Attorney, Agent, or Firm*—McGlew and Tuttle

[57] ABSTRACT

An apparatus for the preparation of mixtures, especially dye solution. The apparatus includes a device for withdrawing a predetermined batch of product at a withdrawal station and for transferring the product to a separate dissolution station (SD). A device is provided for the dissolution of the product in the solvent, disposed in the dissolution station. A programmable electronic device is provided for operating the devices for withdrawal, transfer and dissolution of the product. The device for dissolution includes in a fixed horizontal plate with an annular seal housed in a corresponding channel of the lower surface of the plate making up a tight-sealing element for the mouth of a corresponding cylinder vessel containing the product to be dissolved. The vessel is associated with a vertical operating cylinder for driving the vessel from a lower to an upper position. A doctor blade is provided supported by a vertical shaft which is in a fixed spatial position and goes through a central hole of the plate to be supported by the latter. This vertical shaft is associated to a corresponding driving member for moving the doctor blade. A lump-breaking body is carried by a rod passing through a corresponding hole of the plate. The rod is associated to a corresponding driving member. One or more conduits with valves are provided for the supply of hot or cold water or other solvent into the vessel. An in-line pump is for the withdrawal of the solution from the vessel.

11 Claims, 9 Drawing Sheets

APPARATUS FOR THE PREPARATION OF MIXTURES, ESPECIALLY DYE SOLUTIONS

FIELD OF THE INVENTION

The present invention refers to an apparatus for the preparation of mixtures, especially dye solutions for the textile industry.

BACKGROUND OF THE INVENTION

It is known that in the preparation of dye solutions intended for use in the textile industry, a predetermined amount of dyes in powder, granules or micropearl form is mixed with water or other suitable solvent. The said solution is prepared within a vessel into which the dyeing materials are introduced by controlling their weight by means of a precision scale, the vessel being transferred afterwards in correspondence of a dissolution station which includes a solvent-delivering conduit and mixture-stirring means. The thus obtained solution is then either sucted and conveyed to the selected user or stored within a storage container. Documents IT TO92A960 EP93118274 and U.S. 583726, all of the same owner, disclose a device for the preparation of dye solutions which comprises, in combination, a vessel into which a batch of the product to be dissolved and a predetermined amount of solvent are made to flow, and a structure vertically movable to and away from the said vessel, said structure supporting a conduit for delivering said solvent and means for stirring the product-solvent mixture, said means resulting, during the preparation of the solution, in lowered position and dipped into the said vessel. The said conduit and said stirring means are housed within the cavity of a bell-shaped body which, during the preparation of the solution, has its respective lower base portion dipped into a substantially annular tank which encircles the base of said vessel so as to prevent any leak of liquid from coming in contact with the environment when the stirring means are in operation. Moreover, said vessel is rotatively mounted about the respective central vertical axis to cooperate with the stirring means for the preparation of the solution, particularly upon a stage of treating the paste obtained with the initial admission of the solvent into the vessel.

However, said known device exhibits some technical drawbacks, among which the fact of needing a complex mechanical structure for the vertical displacement of said stirring means and a structure overweight due to the presence of the protection bell and of the tank which surrounds the vessel ensuring the necessary isolation of the latter from the external environment. Moreover, it is necessary to operate in a controlled way also the rotation of the same vessel during the preparation of the solution. All this inevitably implies increasing the cost for the fabrication and the overall maintenance of the plant for the production of the liquid dyes.

Patent FR 1507155 discloses a mixer of the same type, with a vessel intended to hold the mixture and provided with stirring means associated to a support vertically guided towards and away from the vessel.

Also the patent EP 13882 describes a device based upon the same operating principle set forth above.

Moreover, patent U.S. Pat. No. 4,095,287 discloses a device for preparing materials in paste form and which comprises a vessel intended to hold the material to be mixed, and means for mixing said material which are supported by an element associated to corresponding means for vertical movement towards and away from the vessel itself, the latter rotating about its own central vertical axis to assist the mixing means for the preparation of the paste.

But also these known devices technical exhibit drawbacks due to the necessity of lifting and lowering every time the assembly of stirring or mixing means.

SUMMARY AND OBJECT OF THE INVENTION

The main object of the present invention is to overcome the above mentioned drawbacks.

This result has been achieved, according to the invention, by designing an apparatus having the characteristics described in claim 1. Further characteristics are set forth in the dependent claims.

The advantages of the present invention consist essentially in that it is possible to maintain the stirring and mixing means in a fixed spatial position so that the apparatus results easy to make, economical and reliable; that it is possible to simply and accurately attend the operations for the positioning of the vessels in correspondence of the dissolution means, so that while a vessel is in the station for the dissolution of the powdered, granulated or micropearl product, one or more vessels are loaded with the same or other dyeing materials and/or are disposed in a corresponding stand-by position; that the consumption of energy, dye and water or solvent are significantly reduced.

BRIEF DESCRIPTION OF THE DRAWINGS

These and other advantages and characteristics of the invention will be best understood by anyone skilled in the art from a reading of the following description in conjunction with the attached drawings given as a practical exemplification of the invention, but not to be considered in a limitative sense, wherein.

DETAILED DESCRIPTION OF THE PREFERRED EMBODIMENT

Figure 1:
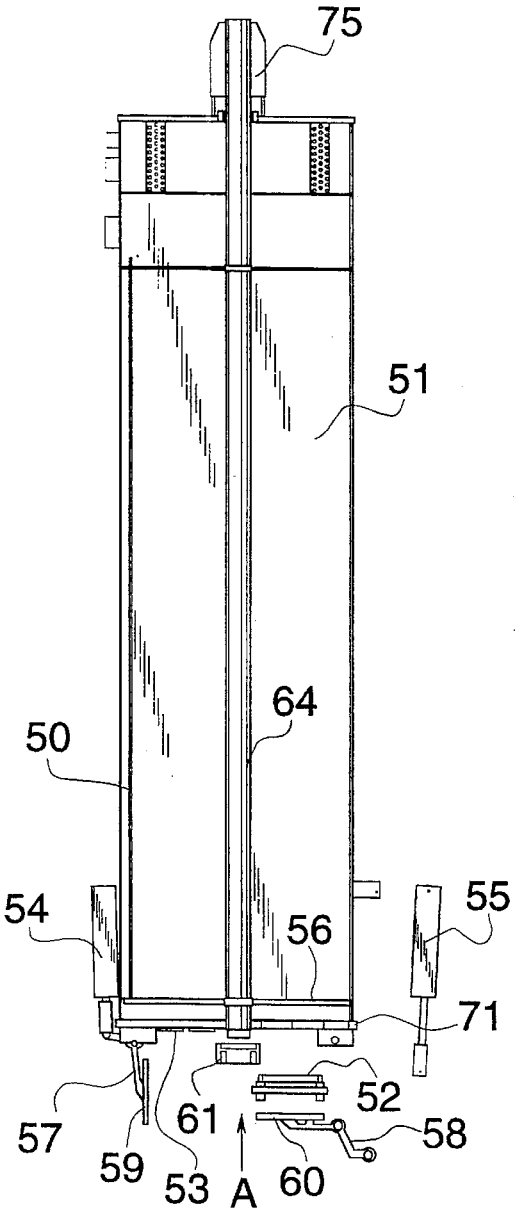
FIG. 1 is a view in longitudinal section and partly exploded of a storage bin for dyeing materials.
Figure 2A:
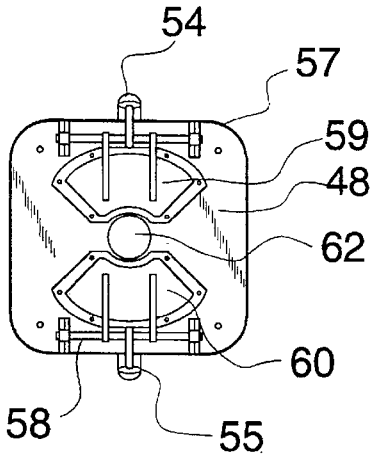
FIG. 2A shows in details the means for the closing and opening of the lower mouth of the storage bin of FIG. 1, in closing condition, as viewed in the direction of arrow A of FIG. 1.
Figure 2B:
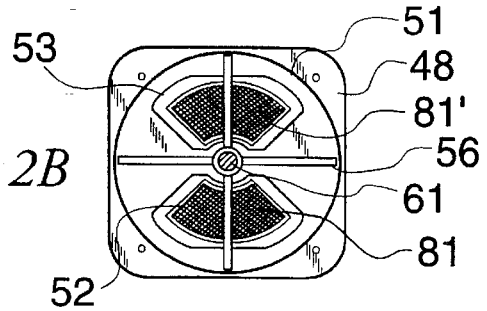
FIG. 2B shows a top view of a detail of the means for the delivery of the materials held in the storage bin of FIG. 1, according to a first embodiment.
Figure 2C:
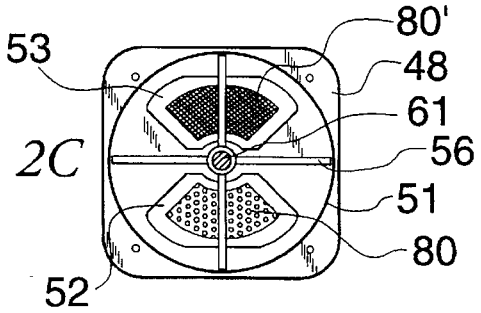
FIG. 2C shows a detail of means as in FIG. 2B, according to a further embodiment.

Disposed at a station (SP) for the withdrawal of the product to be dissolved are a plurality of storage bins (51), each of which contains a predetermined amount of dye in powder, granules or micropearls form. Provided in correspondence of the unloading lower mouth of each storage bin (51) are means for the delivery of said dye, said means including a plate (48) with two apertures (52, 53) which lie opposite with respect to an ideal vertical medium plan of said unloading mouth, and each being provided respectively either with a large-mesh net, that is a sieve (81) and a narrow-mesh sieve (81') or with a perforated grid having large-diameter holes (80) and, respectively, a grid having small-diameter holes (80').

The mesh size of the said sieves (81, 81') and the hole diameter of the said grids (80, 80') are suitably chosen in relation to the morphological characteristics of the product held in the respective storage bin (51).

Figure 10:
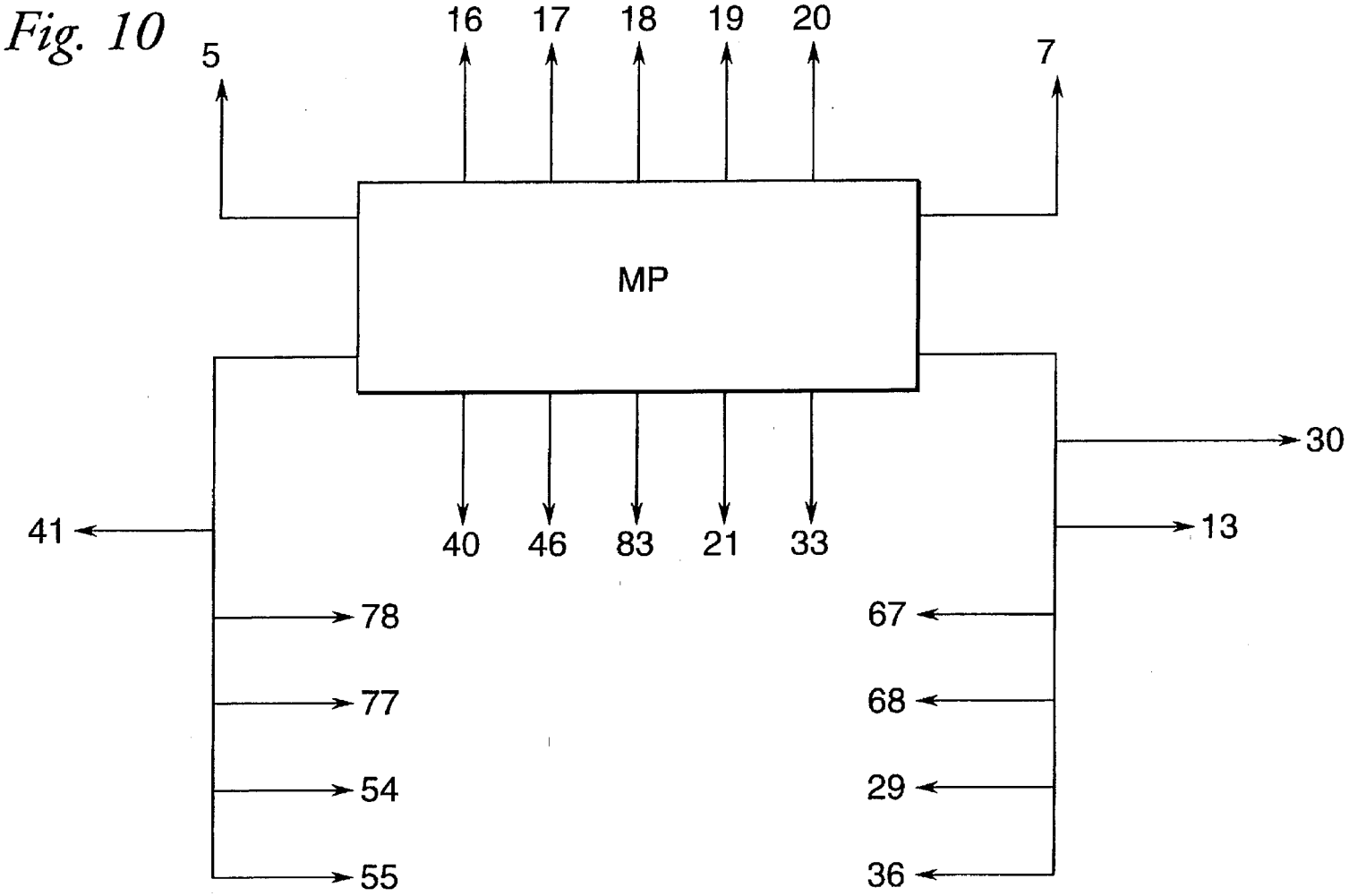
FIG. 10 is a simplified block diagram of the system for operating and controlling an apparatus according to the invention.

The said apertures (52, 53) of the unloading mouth of the storage bin (51) are associated to respective closing/opening plates or straps (59, 60) each of which is engaged by a corresponding operating cylinder (54, 55) through an articulated leverage (57, 58). For the delivery of large quantities of the product stored in the storage bin (51), both the respective plates or straps (59, 60) are disposed in opening position so as to allow the product to come out from both sieves or grids (52, 53) and to fall down for the collection thereof on an underlying cylindrical vessel (1) whose instantaneous weight is controlled by a precision scale (40) associated to programmable electronic means (MP) operating on principles well known to those skilled in the industrial automation technicque—and which will not therefore be described in further details—as schematically shown in FIG. 10.

As the instantaneous weight reading approaches the desired value for the thus delivered product, the plate (60) corresponding to the sieve or grid (52) having meshes or holes of greater dimension is disposed in closed condition, so that the product of the storage bin (51) will flow down only through the other sieve or grid (53). This makes it possible to achieve a remarkable operative accuracy in the metering of the product, with an error in the order of the thousandth of a gram. The said plate (48) for supporting the sieves or grids (52, 53) can be fixed with screw means to the base portion of the storage bin (51) to allow them to be quickly removed in case of replacement or cleaning and/or inspection of the storage bin (51). During the fine delivery of the product, that is, under the condition of the product flowing down only through the fine sieve or grid (53), provision may be made for advantageously activate the rotation of a blade scraper (56) disposed inside the storage bin (51) and fixed in correspondence of the bottom portion of a corresponding vertical control rod (64) so as to result overhanging said sieves or grids (52, 53): the said control rod (64) of the scraper (56) being in turn movable at controlled speed by a corresponding driving member (77) which is made to engage a spindle (75), located on top of the same rod (64) through a corresponding output bush (76) of the motor (77). Upon the activation of said scraper (56) during the fine delivery of the product, a precise and controlled flow of the same product is ensured towards the underlying vessel (1). The said motor member (77), with the respective output bush (76), is supported by a carriage (82) at a level higher than said spindle (75): the said bush (76) being engaged to a corresponding operating cylinder (78) having vertical axis to allow a controlled engagement, respectively, disengagement of the bush (76) with respect to spindle (75). In order to achieve the engagement of the bush (76) with the spindle (75), the cylinder (78) is activated in such a way as to obtain the lowering of the bush (76) with the insertion of the spindle (75) into the cavity of the latter. Vice versa, in order to disengage the spindle (75) from the bush (76) of motor (77), the same bush (76) is made to move upwards by the said cylinder (78). Said carriage (82) is associated to a respective driving member (46) and is mounted on straight guides (46') located at the bottom of a fixed framework (47) to enable the product to move from a withdrawal station (SP) to a separate dissolution station (SD) and vice versa. Moreover, said carriage (82) is provided with clamp means (36) for grasping, holding and releasing the vessels (1) in order to move them from the station (SP) for the withdrawal of the products to the one (SD) for the dissolution thereof. The carriage (82) is also provided with an operating cylinder (83) acting on a slide (84) which supports the vessel (1), the scale (40) and the means (36) for grasping and holding the vessel (1), and is mounted on wheels (85) sliding on the base (82') of carriage (82) along a direction substantially orthogonal to the one for the movement to and from the dissolution station (SD). Said cylinder (83) is in turn associated to electronic control means (MP). In this way it is possible to dispose both the means (36) for grasping the vessels (1) and the bush (76) of motor (77) in correspondence of any storage bin (51).

Figure 3A:
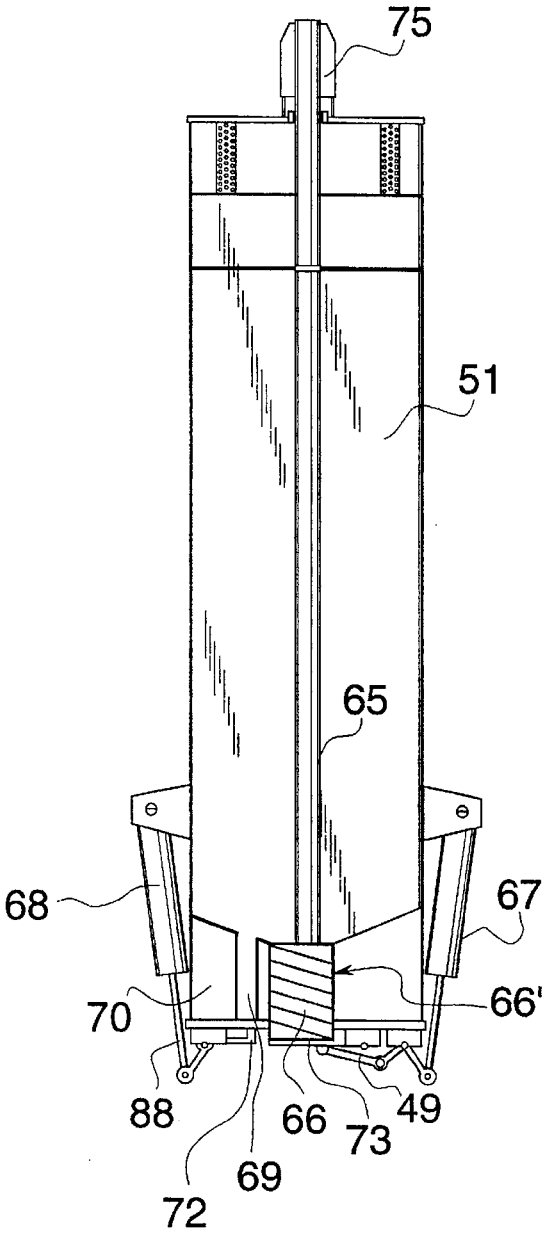
FIG. 3A is a view in longitudinal section of a storage bin of the type shown in FIG. 1, with means for the delivery of dyeing materials exibiting good fluidization.
Figure 3B:
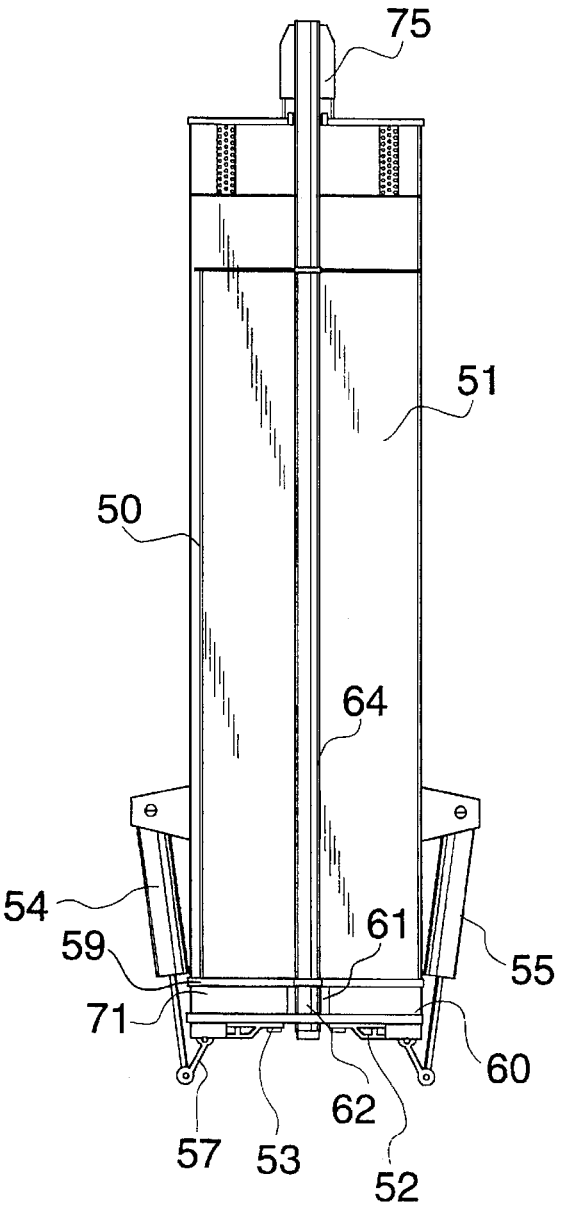
FIG. 3B is a view in longitudinal section of a storage bin of the type shown in FIG. 1, with means for the delivery of dyeing materials which are more difficult to fluidize.

To take into account the different ways of efflux of the products, in relation to their respective fluidization properties, that is, in relation to the nature thereof, means may be disposed in correspondence of the lower base of each storage bin, for delivering products to said vessel (1) other than those described above. More particularly, reference being made to FIGS. 3A, 4 and 6A of the attached drawings, said means comprise a pipe (69) which puts in direct communication the cavity of the storage bin (51) with the outside, and an endless screw (66) inserted into a cylindrical jacket having vertical axis (66') and operated by a corresponding drive rod (65) provided on top with a spindle (75): said spindle (75) being operable for the insertion thereof into a bush (76) of said driving member (77). The rotation of the endless screw (66) implies the transfer of the product from the storage bin (51) to the outside, along a substantially spiral trajectory which corresponds to the channel defined by the threading of the same screw (66) in cooperation with the internal wall of the cylindrical jacket (66'). The lower or unloading mouth of said conduit (69) is provided with a plug (72) associated to an operating cylinder (68) via an articulated leverage (88). Similarly, the screw outlet (66) is provided with a closing plug (73) associated to a corresponding operating cylinder (67) via an articulated leverage (49). The delivery of the material outputting from the conduit (69) is controlled by the opening/closing of the plug (72), while the material outputting from the screw (66) is controlled both by opening/closing plug (73) and by varying the rotary speed of the rod (65) which carries the screw (66), said speed being varied according to the desired flowrate of the product exiting from the storage bin (51). Said conduit (69) and said screw (66) with respective tubular jacket (66')

are advantageously mounted on a plate (70) able to be connected by screw means to the base of the storage bin (51) so as to allow a quick removal thereof when the need arises for inspecting the storage bin (51) and/or replacing or servicing the product-delivering unit. For the delivery of large amounts of product, only the conduit (69) outlet is used by controlling its opening/closing through a corresponding plug (72) until the instantaneous weight draws close to the desired value. Then, the outlet of conduit (69) is closed by the piston (68), the outlet of the endless screw (66) is opened by the piston (67) and the rotation of the rod (65) is activated at a speed corresponding to the desired flowrate of the outputting product, until the desired product weight is obtained as controlled by said scale (40).

Figure 4:
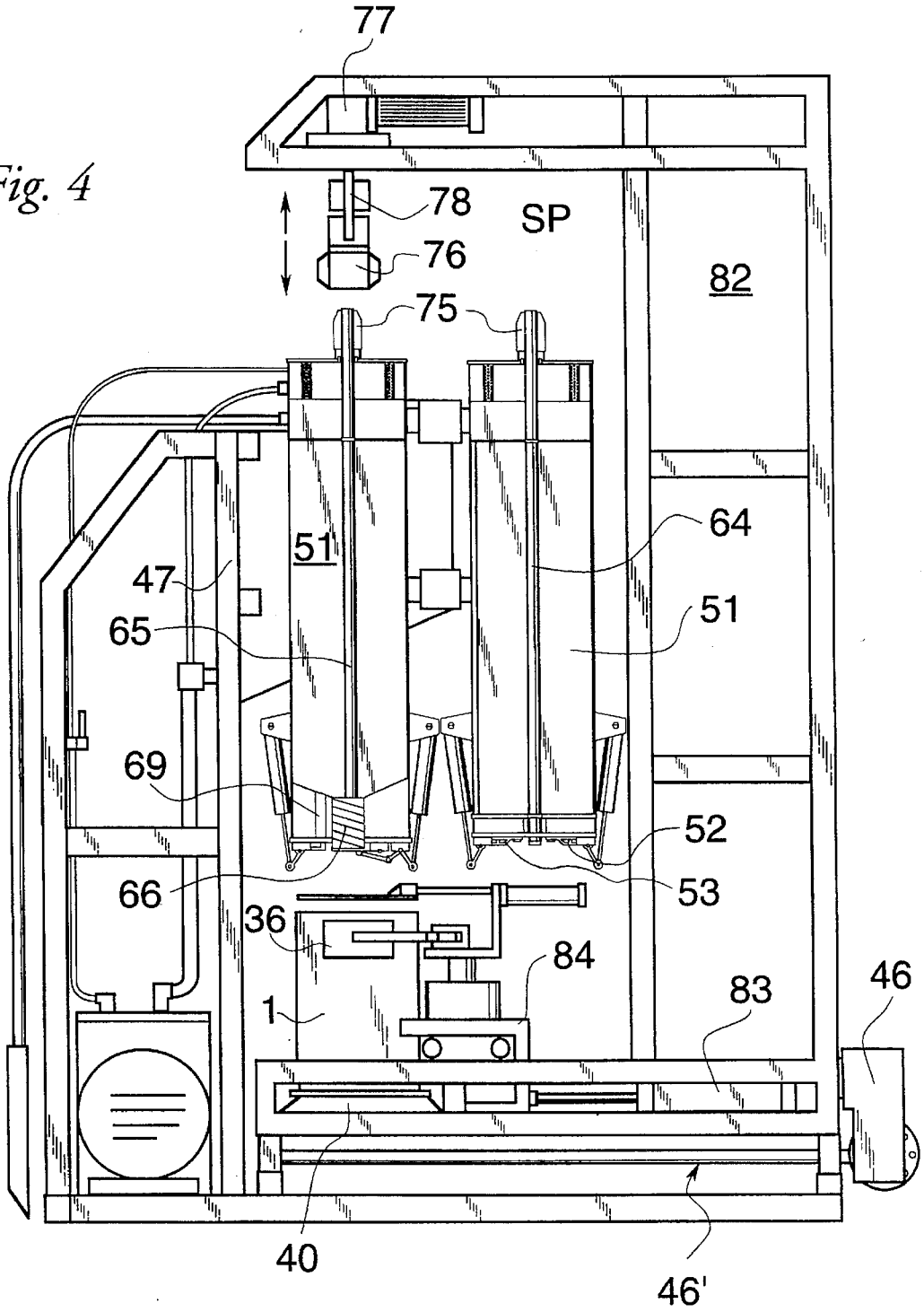
FIG. 4 is a side view in longitudinal section of an apparatus for metering dyeing materials, according to the invention.
Figure 6B:
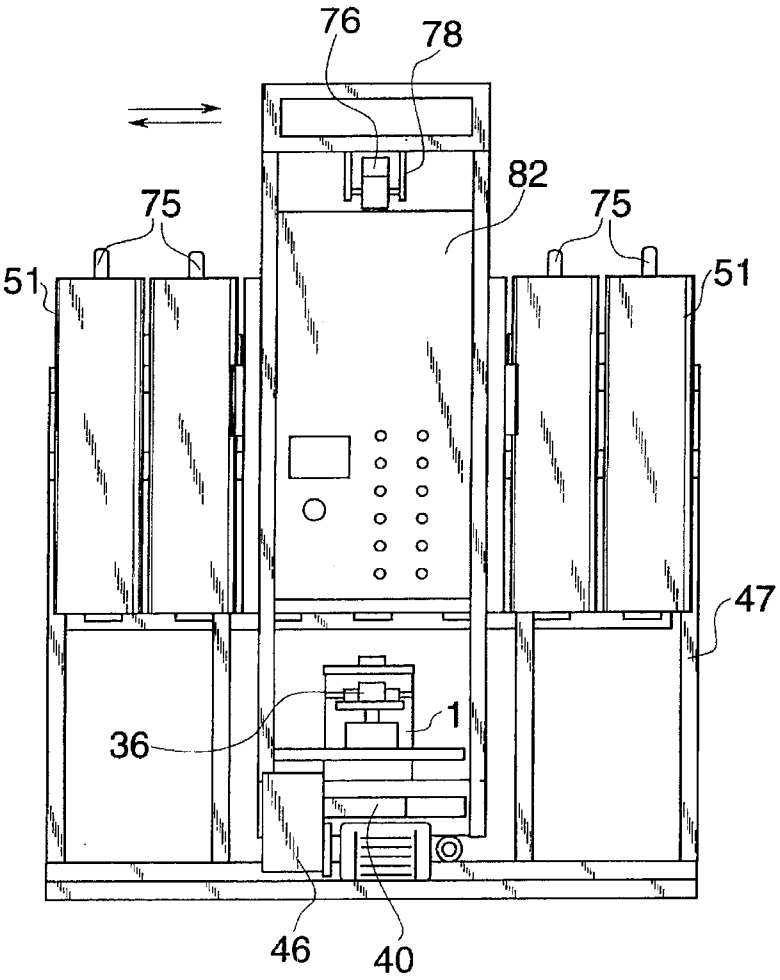
FIG. 6B is a schematic front view of the apparatus of FIG. 6A.
Figure 6A:
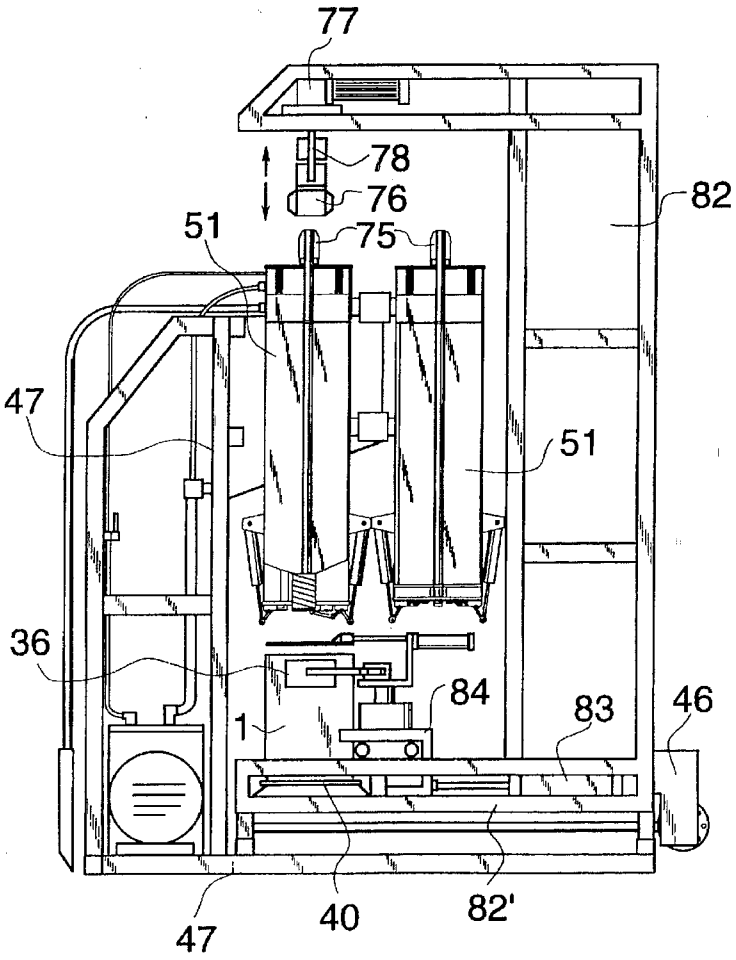
FIG. 6A is a schematic side view of an apparatus according to the invention.
Figure 7:
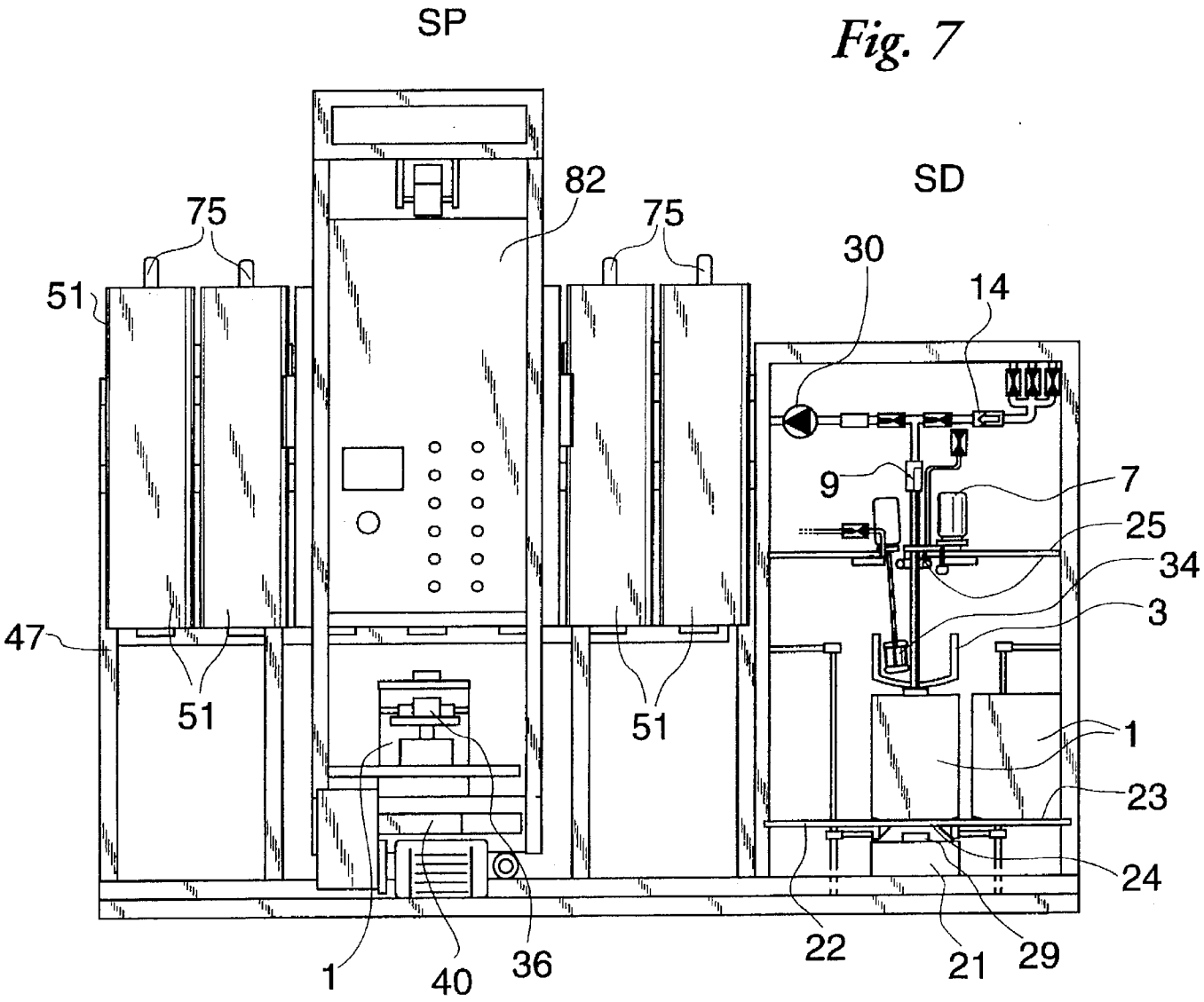
FIG. 7 is a schematic front view of an apparatus for the preparation of dye solutions, according to the invention, which shows the dyes delivering means being associated to the dyes mixing means.

It will be appreciated that the same apparatus may be provided with one or more storage bins all equipped with delivery means of sieve or grid (52, 53) type and, in combination, with one or more storage bins equipped with delivery means of channel (69) and endless screw (66) type (see FIGS. 4 and 6A). Usually, provision is made for storing products of different nature within the various storage bins (51), so as to allow for the preparation of a wide range of solutions.

Said storage bins (51) may be advantageously provided inside with a peripheral scraper (50) supported by respective rods (64) or (65), to perform the removal of the product possibly adhering to the respective internal walls.

The above described means allow the delivery of the product stored in the storage bins (51) to be made with extreme accuracy and rapidity both in case of small and large batches.

The number of said storage bins (51) can be made to vary at will to meet changing requirements for production capacity and available space by simply adding or removing a desired number of storage bins.

An apparatus for dissolving a powdered, granulated or micropearl product, according to the invention comprises, advantageously, a horizontal table (21) having a number, for example three, of seats for a corresponding number of vessels (1); said table (21) being located at a station (SD) for the dissolution of the product taken out from the withdrawal station (SP) and being mounted for a controlled rotation about its vertical central axis by a corresponding driving member—not shown for sake of clarity in the figures of the accompanying drawings—to allow said vessels (1) to be disposed in respective positions for the dissolution (24), loading (22) and unloading (23) of the product, as described in more detail later on.

Each of said seats of the table (21) consists advantageously of a substantially circular hole on the edge of which a crown element (21') having equal profile and intended to receive the base of a corresponding vessel (1) is made to rest.

Advantageously, the seats of the table (21) accomodating the vessels (1) are angularly equidistant.

Described below by way of example is a driving cycle for moving the vessels between the station (SP) for the withdrawal of the product and the station (SD) for the dissolution thereof.

Initially, the carriage (82) is driven by the respective motor (46) until it results in correspondence of the position (22) of the table (21) in which the vessel (1) is empty. Afterwards, the said clamp means (36) carry out the withdrawal of the empty vessel (1) to load it onto the carriage (82) and onto the scale (40). Thereafter, the carriage (82) is driven towards the station (SP) of storage bins (51) and, to be more precise, towards the storage bin (51) containing the selected product. Here takes place the metering of the product according to the above described procedures. Upon completion of the metering, the carriage (82) moves back to the table (21), and the vessel (1) is placed in the seat corresponding to the unoccupied position (22). The laying of the vessels (1) being allowed by the release of the clamp means. At this point, the carriage (82) is made to advance still further until said means (36) are laid down in correspondence of the position (23) of table (21), in which another empty vessel (1) is removed by the means (36) and loaded onto the carriage (82) in correspondence of the scale (40), to be finally routed back to station (SP) of storage bins (51) to allow for another metering operation. At the same time, the table (21) rotates a step forwards to place the vessel (1), with the product already metered therein, in correspondence of the dissolution means (MD), that is, at position (24), and in such a way that the empty vessel (1), formerly placed at position (24), will result shifted to position (23), while the position (22) will correspond to a free place. In this way, the initial positions of vessels (1) are continuously resumed in order to repeat the cycle whenever the carriage (82) moves up to the table (21) at the end of every metering operation. The driving of vessels (1) in a direction orthogonal to the motion of carriage (82) is ensured by the platform (84) associated to the cylinder (83).

Figure 5B:
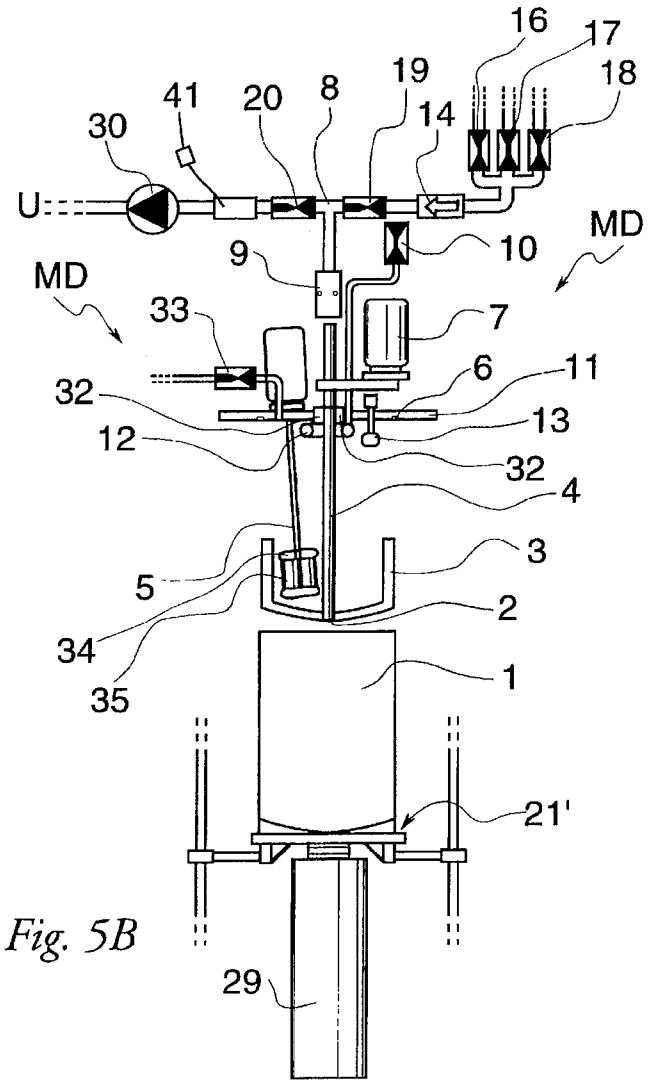
FIG. 5B is a schematic view of the means of FIG. 5A, in stand-by or rest condition.
Figure 5A:
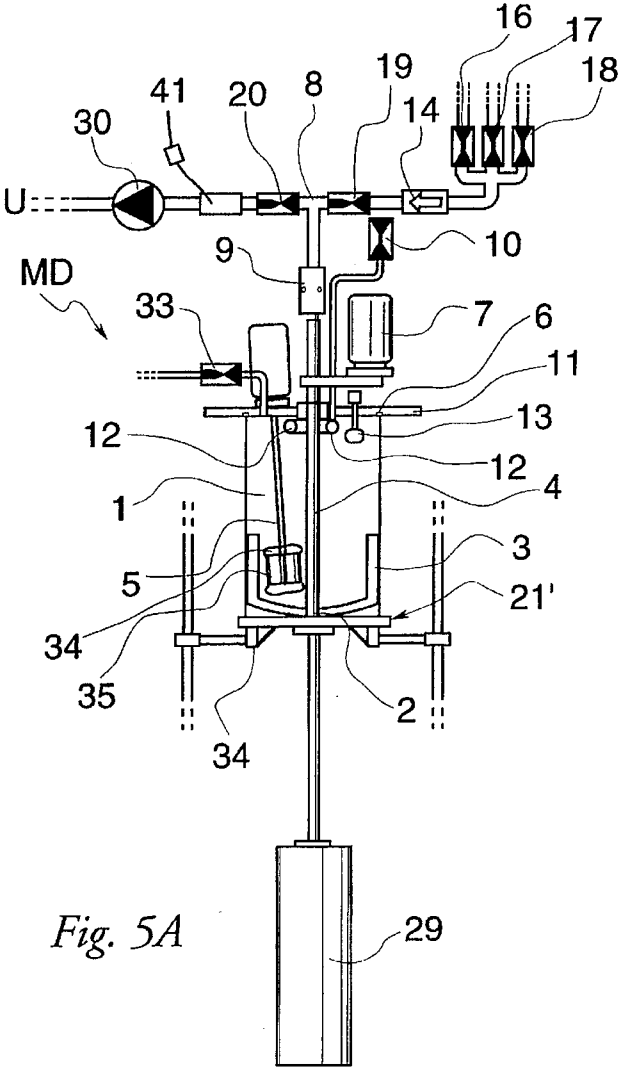
FIG. 5A is a schematic view of dye-dissolving means of an apparatus according to the invention, in operating condition.
Figure 8:
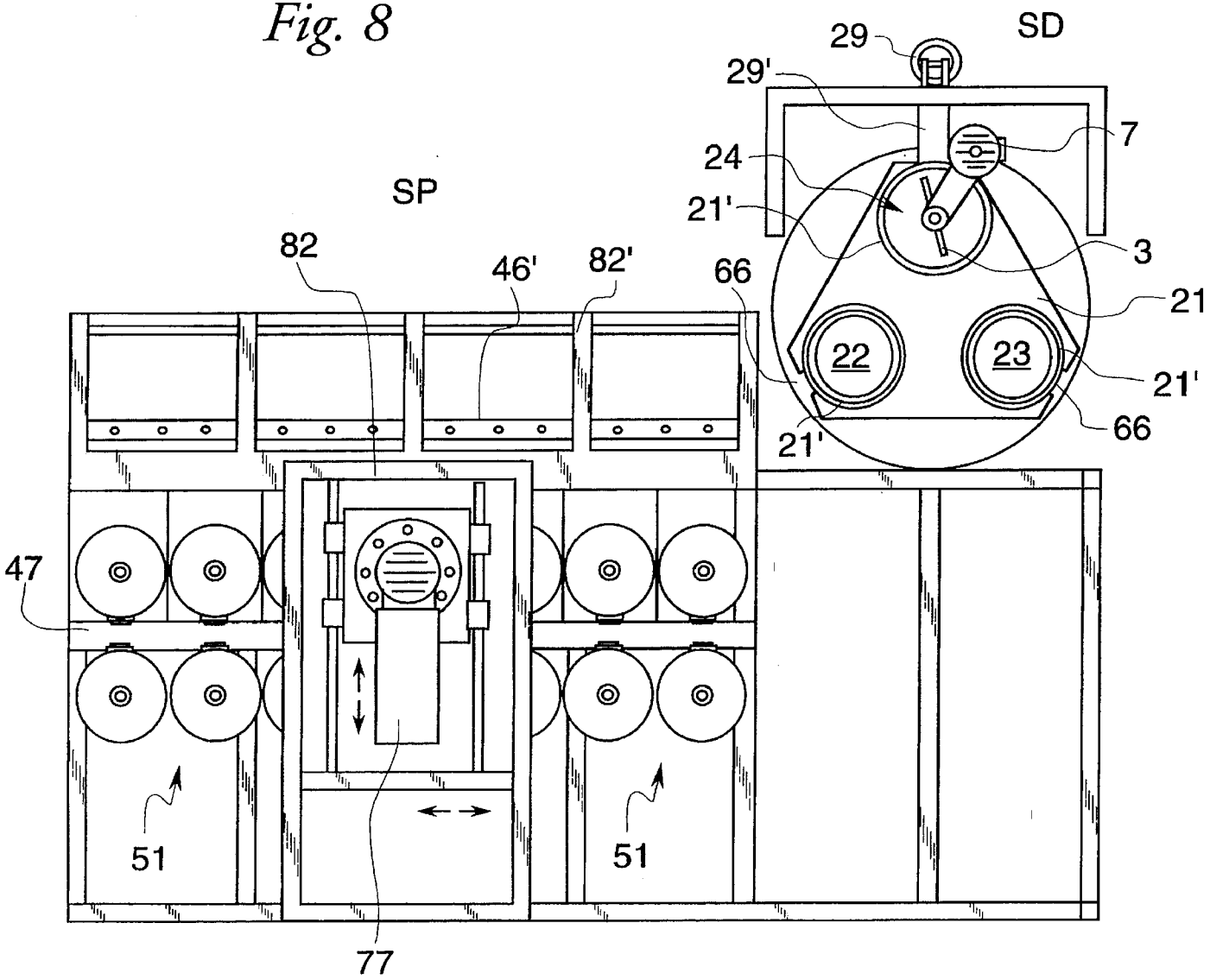
FIG. 8 is a top view of the apparatus of FIG. 7.
Figure 9:
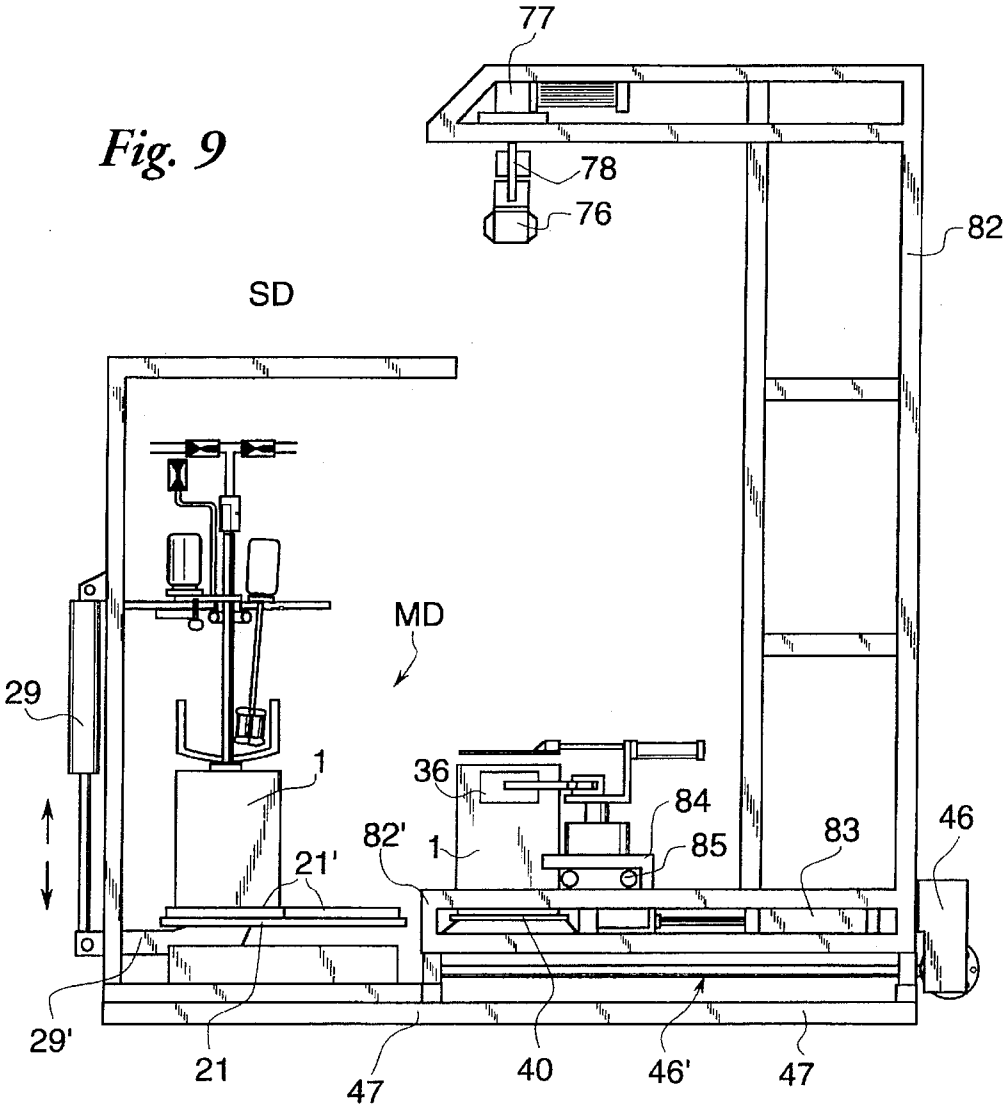
FIG. 9 is a side view of the carriage for moving the vessels in correspondence of the dissolution station.

Advantageously, according to the invention, an operating cylinder (29) is mounted in correspondence of said position (24) in the dissolution station (SD) for the vertical movement of the respective vessel (1) to and from the dissolution means (MD) (see FIGS. 5A, 5B and 9), which means comprise, in combination, a fixed horizontal plate (11), with an annular seal (6) housed in a corresponding channel of the lower surface of the plate (11) making up a tight-sealing element for the mouth of the vessel (1) as the latter is in lifted condition, a mixing and stirring group (25) with a doctor blade (3) operable through a hollow shaft (4) with a lower port (2), said shaft being associated to a corresponding driving member (7) and made solid to said plate (11) by going through a central hole thereof to be housed in a bearing (32): the said hollow shaft (4) being in turn connected, by means of a rotating joint (9), to a fixed "T" joint (8) which communicates upstream with a plurality of conduits with valves (16, 17, 18) for the supply of hot or cold water or other suitable solvent, and downstream with a conduit for the suction and evacuation of the solution from the vessel (1) through a valve upstream of which a pump (30) is provided for delivering the solution from the vessel (1) to the selected user (U). The said cylinder (29) for vertically moving the vessel (1) in the dissolution station (SD) may be advantageously placed either below the table (21), as schematically illustrated in FIGS. 5A and 5B of the accompanying drawings, or at the rear of the dissolution means (MD) and with its stem being provided with a bracket (29') located below the table (21) parallel thereto, as schematically illustrated in FIG. 8. In this latter case, suitable apertures (66) are provided in the said table (21) to allow the bracket (29') to pass therethrough.

Said joint (9) being well known to those skilled in the art and available on the market. Suitably provided downstream of said valves (16, 17 and 18), that is, upstream of said joint (9), is a shutoff valve (19). Upon the opening of valve (19) for a predetermined time related to the nature of the product and of the solvent, as well to the wanted type of solution, the liquid from the conduits of said valves (16, 17 and 18) is caused to enter the vessel (1) containing the product to be dissolved.

Advantageously, means are also provided for admitting compressed air into the vessel (1) with a conduit going through a corresponding hole of said plate (11) and provided with a shutoff valve (33), so as to have the evacuation of the solution from the vessel (1) helped by the said pump (30) in operative condition for the effect of the pressure thus exerted on the liquid inside the vessel (1).

Provision is also made for a motor-driven stirrer (5) anchored to said plate (11) and comprising a rod at the lower end of which more propellers (34), connected between them by metal wires (35) which act as lump-breaking elements, are fixed. The said rod is suitably inclined of a predetermined angle, 15° for example, with respect to the vertical direction, so that its rotation will further facilitate the dissolution of the product. The inclination to the vertical of said rod (5) may also range between 10° and 30°.

Described herebelow, by way of non limitative example, is a cycle for the preparation of a solution by means of the apparatus according to the invention.

The vessel (1) at the start position (24) is lifted up by the cylinder (29) until its upper edge matches perfectly with the seal (6) of the fixed plate (11) of the unit (25), so as to achieve the tight sealing of the same vessel. Then, the doctor blade (3) is driven into a slow rotation by the motor (7) and the valves (19) and (16), (17) or (18) are opened to supply the solvent through the orifice (2) of shaft (4) to obtain a mxture to be worked by the doctor blade (3) while the vessel (1) is in fixed spatial position. At this point, more solvent is added, and the rotary speed of the doctor blade (3) is increased. At the same time, the starting of the stirrer (5) allows its speedly rotating propellers (34) and respective wires (35) to ease the dissolution of the product within the solvent. Upon completion of this operation—which has a preset duration related to the nature of the solvent and the product to be dissolved—the transfer of the solution from the vessel (1) to the selected user (U) is started. To this purpose, the valve (20) is opened, the pump (30) is activated and compressed air is admitted into the vessel (1) through the valve (33). The solution is aspirated through the cavity of shaft (4). The washing of the emptied out vessel (1), unit (25) and conduit (8) is obtained by delivering water into the vessel (1), with the doctor blade (3) and the stirrer (5) being in motion, through a set of nozzles (12) located below said plate (11) and then by sucting the washing liquid with the same procedures as described for the suction of the solution. The amount of solvent admitted into the vessel (1) is assessed by a volumetric meter (14) located downstream of valves (16, 17, 18). Safety probes (13, 41) enable the minimum and maximum levels of the liquid to be taken under control. More specifically, the probe.(13) is of float type and intended to detect the maximum level reached inside the vessel (1), and the probe (41) is for detecting the presence of liquid in the respective conduit. At the end of the dissolution and washing operations, the vessel emptied of the solution and cleaned is lowered by means of cylinder (29) and moved back to its start position for a further operating cycle.

According to a further embodiment, provision is made for differentiating the route for the supply of the solvents from the one for the suction of the solution. To this end, the conduit for the suction of the solution from the vessel (1) is advantageously distinct from that (4) for the supply of the solvent. For example, for the intake of the solvents into the vessel (1) containing the product to be dissolved, the said nozzles (12) may be suitably associated to the conduits of the valves (16, 17, 18) and to the conduit for the supply of the washing liquid by means of a switching valve, not shown for sake of clarity in the figures of the attached drawings.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

We claim:

1. Apparatus for the preparation of mixtures, especially dye solutions starting from a product in powder, granules or micropearls form to be dissolved in a liquid solvent, comprising means for withdrawing a predetermined batch of product at a withdrawal station (SP) and for transferring the product thus metered from said withdrawal station (SP) to a separate dissolution station (SD), means (MD) for the dissolution of the product in said solvent which are disposed in said dissolution station (SD) and programmable electronic means (MP) for operating said means for the withdrawal, transfer and dissolution of the product, wherein said means (MD) for dissolving the product comprise, in combination:

a fixed horizontal plate, with an annular seal housed in a corresponding channel of the lower surface of the plate making up a tight-sealing element for the mouth of a corresponding cylindrical vessel containing the product to be dissolved: said vessel being associated to a vertical operating cylinder for driving same vessel from a lower to an upper position to cause the mouth thereof to match the seal of said plate and vice versa;

a doctor blade supported by a vertical shaft which is in fixed spatial position and goes through a central hole of said plate to be supported by the latter, so as to make the doctor blade lie in a position below the plate, the same shaft being associated to a corresponding driving member for moving the doctor blade: said vessel being kept in fixed spatial position during the rotation of the doctor blade;

a lump-breaking body carried by a rod passing through a corresponding hole of said plate, so as to make the lump-breaking body lie in a position below the plate: said rod being associated to a corresponding driving member;

one or more conduits with valves for the supply of hot or cold water or other solvent into the vessel as the latter is in lifted position;

at least a conduit dipping into the vessel as the latter is in lifted condition, with a valve and an in-line pump for the withdrawal of the solution from the vessel.

2. Apparatus according to claim 1, wherein said rod for supporting the lump-breaking means is inclined to the vertical of an angle ranging between 10° and 40°.

3. Apparatus according to claim 1, comprising means for the intake of compressed air into the vessel as the latter is in lifted condition, with a conduit going into a corresponding hole of said plate and provided with a shut-off valve, so that the pressure thus exerted on the liquid present within the vessel will assist the action of the pump when this is in operative condition for the evacuation of the liquid out of the vessel.

4. Apparatus according to claim 1, wherein within said dissolution station (SD) a horizontal table is provided having a plurality of seats for more vessels, the table being rotatively mounted about its central vertical axis and driven into intermittent rotation by a corresponding driving member so as to place said vessels in succession at the corresponding dissolution, storage and stand-by positions.

5. Apparatus according to claim 4, wherein the seats of said table are angularly equidistant.

6. Apparatus according to claim 1, wherein the seats of said table are angularly equidistant.

7. Apparatus according to claim 1, comprising means, with more nozzles associated to a corresponding supply conduit and lying below said plate, for washing the vessel in lifted condition after the withdrawal of the solution therefrom.

8. Apparatus according to claim 1, wherein said shaft is hollow, has a lower port and is connected to said conduits for the supply of the solvent to allow the latter to flow into the vessel while the latter is in lifted condition.

9. Apparatus according to claim 8, wherein that said hollow shaft is also connected to means for the evacuation of the solution from the vessel.

10. Apparatus according to claim 1, wherein in said station (SP) for the withdrawal of the product one or more storage bins are installed with means for delivering and metering the product within the vessel.

11. Apparatus according to claim 1 wherein said means for the transfer of the product into the vessel comprise a carriage movable on a track associated to a fixed framework and driven by a corresponding driving member for the motion thereof from the station (SP) for the withdrawal of the product to the one (SD) for the dissolution thereof and vice versa: said carriage being provided with a platform for a vessel and able to translate along a direction orthogonal to the axis of motion of the carriage to allow the positioning of the vessel in correspondence of means for the metering of the product to be dissolved and down onto the table, said carriage being further provided with clamp means for the withdrawal, hold and release of the vessel, which means are associated to said platform.

* * * * *